United States Patent [19]

Yasutake et al.

[11] Patent Number: 4,729,428

[45] Date of Patent: Mar. 8, 1988

[54] HEAT EXCHANGER OF PLATE FIN TYPE

[75] Inventors: Takayuki Yasutake; Tetsuo Shibata, both of Oyama, Japan

[73] Assignee: Showa Aluminum Corporation, Sakai, Japan

[21] Appl. No.: 879,532

[22] Filed: Jun. 27, 1986

Related U.S. Application Data

[62] Division of Ser. No. 746,472, Jun. 19, 1985, abandoned.

[30] Foreign Application Priority Data

| | | | |
|---|---|---|---|
| Jun. 20, 1984 | [JP] | Japan | 59-128284 |
| Jun. 20, 1984 | [JP] | Japan | 59-128285 |
| Jun. 20, 1984 | [JP] | Japan | 59-128286 |
| Jul. 20, 1984 | [JP] | Japan | 59-110413[U] |

[51] Int. Cl.[4] ..... F28F 3/00

[52] U.S. Cl. ..... 165/166; 165/153

[58] Field of Search ..... 165/166, 152, 153, 167, 165/179, 183

[56] References Cited

U.S. PATENT DOCUMENTS

| | | | |
|---|---|---|---|
| 3,372,743 | 3/1968 | Pall et al. | 165/166 |
| 3,881,547 | 5/1975 | Lavering | 165/183 X |
| 4,434,845 | 3/1984 | Steeb | 165/166 X |

FOREIGN PATENT DOCUMENTS

| | | | |
|---|---|---|---|
| 517964 | 1/1955 | Belgium | 165/152 |
| 506471 | 10/1954 | Canada | 165/152 |

*Primary Examiner*—Albert W. Davis, Jr.
*Assistant Examiner*—Richard R. Cole
*Attorney, Agent, or Firm*—Armstrong, Nikaido, Marmelstein & Kubovcik

[57] ABSTRACT

A heat exchanger of the plate fin type having first fluid channels and second fluid channels arranged alternately and each separated from the adjacent channel by a flat metal plate. At least one of the first fluid channel and the second fluid channel is formed by a pair of adjacent flat metal plates and a spacer interposed between the flat plates. The spacer comprises a pair of side walls each joined to and interconnecting a pair of opposed edges of the two flat plates at each side thereof, a connecting wall interconnecting the two side walls, and fins provided on the connecting wall at an angle therewith and joined at their forward ends to the flat plate, the fins extending in parallel with the direction of flow of fluid through the fluid channel. The heat exchanger is fabricated by arranging plate plates, spacers, fins and spacer bars in layers and joining the parts together by brazing at the same time.

2 Claims, 17 Drawing Figures

HEAT EXCHANGER OF PLATE FIN TYPE

This application is a division of application Ser. No. 746,472, filed June 19, 1985, now abandoned.

BACKGROUND OF THE INVENTION

The present invention relates to heat exchangers of the plate fin type for use in oil coolers, condensers, evaporators, etc., and more particularly to a heat exchanger of the plate fin type which has first fluid channels and second fluid channels arranged alternately and each separated from the adjacent channel by a flat metal plate.

The term "aluminum" as used herein includes pure aluminum, commercial pure aluminum containing small amounts of impurities and aluminum alloys. The terms "front" and "rear" are used based on the direction of flow of a fluid through the first fluid channel which is formed by flat plates and a spacer; the term "front" refers to the direction in which the fluid flows, and the term "rear" to the opposite direction. The terms "right" and "left" are used as the heat exchanger is viewed by a person facing the front.

Conventional heat exchangers of the plate fin type have first fluid channels and second fluid channels for a fluid different from the fluid through the first channels, the first and second channels being arranged alternately and separated by a flat metal plate. A side bar is interposed between the opposed edges of the adjacent flat plates at each side thereof, and a corrugated fin is provided between two side bars. For example, brazing sheets, side bars and corrugated fins are joined together by a vacuum brazing process to assemble such a heat exchanger.

However, the conventional plate fin-type heat exchanger, which comprises a large number of parts, has the problem that the step of setting the parts requires much time and is not amenable to automation, consequently making it impossible to manufacture heat exchangers efficiently.

SUMMARY OF THE INVENTION

The present invention provides a heat exchanger of the plate fin type which is free of the above problem.

The heat exchanger of the plate fin type according to the invention has first fluid channels and second fluid channels arranged alternately and each separated from the adjacent channel by a flat metal plate. At least one of the first fluid channel and the second fluid channel is formed by a pair of adjacent flat metal plates and a spacer interposed between the flat plates. The spacer comprises a pair of side walls each joined to and interconnecting a pair of opposed edges of the two flat plates at each side thereof, a connecting wall interconnecting the two side walls, and fins provided on the connecting wall at an angle therewith and joined at their forward ends to the flat plate, the fins extending in parallel with the direction of flow of fluid through the fluid channel. Since the side walls, the connecting wall and the fins are integral to form the spacer, the space needs only to be interposed between a pair of flat plates. Accordingly, the heat exchanger can be constructed of a reduced number of parts, which can be set within a greatly shortened period of time, and the setting step is amenable to automation. As a result, the heat exchanger can be produced with an improved efficiency.

The present invention will be described below in greater detail with reference to the accompanying drawings.

DESCRIPTION OF THE PREFERRED EMBODIMENTS

Figure 1:
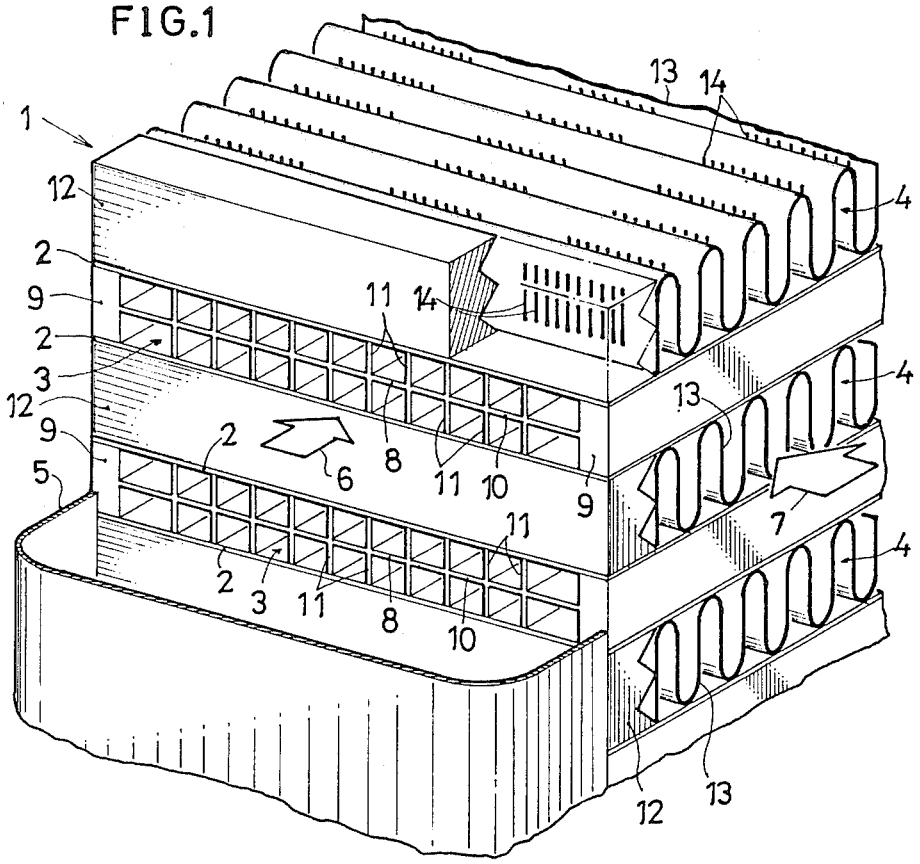
FIG. 1 is a fragmentary perspective view partly broken away and showing an embodiment of plate fin-type heat exchanger of the present invention for use as an oil cooler.

Throughout the drawings, like portions and like members are referred to by like reference numerals.

Figure 2:
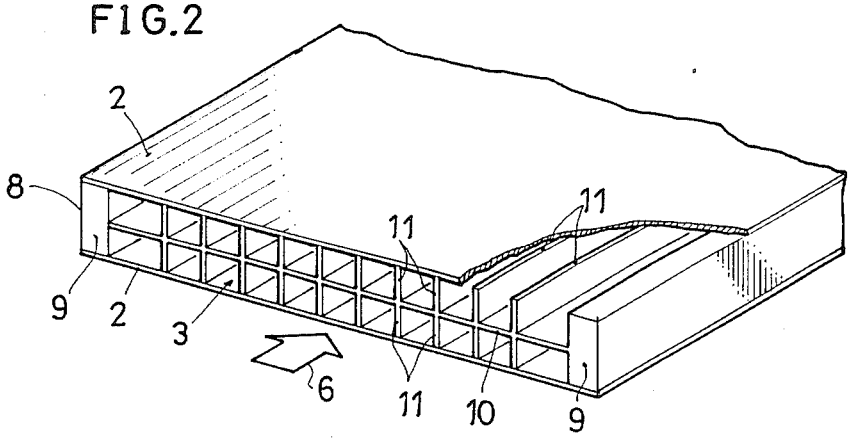
FIG. 2 is a fragmentary perspective view partly broken away and showing a first fluid channel portion of the embodiment of FIG. 1.

FIGS. 1 and 2 show a first embodiment of the present invention, i.e. a heat exchanger 1, which is to be used as an oil cooler. The heat exchanger 1 has first fluid channels 3 and second fluid channels 4 arranged alternately in a vertical direction and each separated from the adjacent channel by a horizontal flat aluminum plate 2. An oil flows through the first fluid channels 3 in the direction of arrows 6 in FIGS. 1 and 2. Air flows through the second fluid channels 4 in the direction of arrows 7 in FIG. 1. Both the channels 3 and 4 are so arranged that these fluids pass therethrough in an intersecting fashion when seen from above. The front and rear ends of the first fluid channels 3 are in communication with header tanks 5 arranged at the front and rear ends of the heat exchanger 1.

Each first fluid channel 3 is formed by a pair of upper and lower flat plates 2, and a spacer 8 of extruded aluminum material interposed between the two flat plates 2 and joined to the flat plates 2 by brazing. The spacer 8 comprises a pair of vertical side walls 9 interconnecting the opposed edges of the upper and lower flat plates 2 at each of the right and left sides thereof, a horizontal connecting wall 10 in parallel with the flat plates 2 and interconnecting the two side walls 9 at the midportion of the height thereof, and vertical fins 11 extending vertically from each of the upper and lower surfaces of the connecting wall 10 and arranged at a specified spacing transversely of the flat plates 2 (i.e. in right-to-left direction), the fins 11 being joined at their forward ends to the flat plate 2 and extending longitudinally of the plate 2 (i.e. in front-to-rear direction). The side walls 9 have a larger thickness than the fins 11 and the connecting wall 10. When the heat exchanger is used as an oil cooler in a chemical plant or the like installed in a place, such as desert, which is liable to be exposed to sand dust or particles including pebbles, the side walls 9 will not break or become damaged even if struck on their surface by pebbles or the like. Accordingly, there is no likelihood that the oil will leak from the channel 3.

Each of the second fluid channels 4 for passing air is formed by a pair of upper and lower flat plates 2, a pair of front and rear spacer bars 12 made of extruded aluminum material and providing front and rear walls, and a corrugated aluminum fin 13 provided between these spacer bars 12 and having ridges and furrows extending in parallel with the spacer bars 12, i.e. at right angles with the fins 11. The corrugated fin 13 is formed with a large number of louvers 14. The right and left ends of the second fluid channel 4 are open to the atmosphere. Air is forcedly or spontaneously passed through the channel 4.

With the structure described above, the oil flowing through the first fluid channels 3 in the direction of arrows 6 is cooled by the air flowing through the second fluid channels 4 in the direction of arrows 7.

The heat exchanger 1 is fabricated by arranging aluminum brazing sheets, spacers 8, pairs of spacer bars 12 and corrugated fins 13 in layers as illustrated and described above, and joining these parts together, for example, by vacuum brazing. In this case, the brazing sheets provide the flat plates 2 on brazing. The aluminum brazing sheet used for brazing is not limitative; it is possible to use as the flat plates 2 aluminum panels each having a brazing material applied to its upper and lower surfaces by a brush or the like and to join the components into the heat exchanger 1 by the brazing material.

FIGS. 3 to 10 show modifications of the first fluid channel 3 for oil of the heat exchanger for use as an oil cooler.

Figure 3:
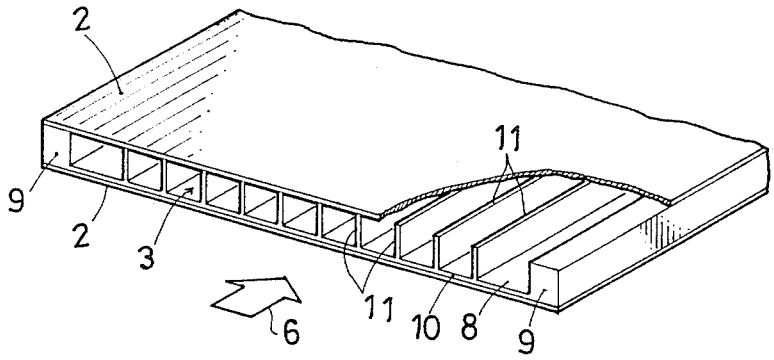
FIG. 3 is a fragmentary perspective view partly broken away and showing a first modification of the first fluid channel.

The spacer 8 shown in FIG. 3 includes a connecting wall 10 in face-to-face contact with the lower flat plate 2, and vertical fins 11 extending upright from the upper surface of the connecting wall 10 and arranged at a specified spacing transversely of the plate 2.

Figure 4:
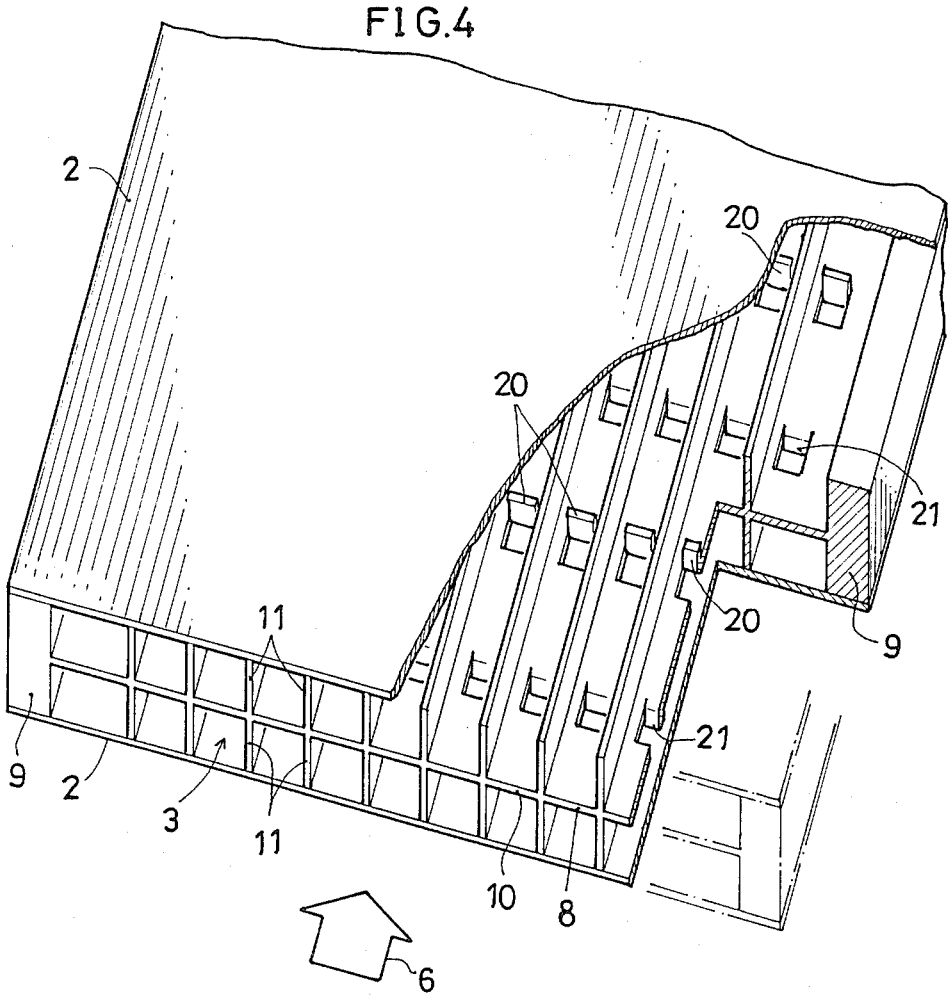
FIG. 4 is an enlarged fragmentary perspective view partly broken away and showing a second modification of the same.

Referring to FIG. 4, a connecting wall 10 is provided on its upper and lower surfaces with turbulence producing projections 20 and 21, respectively, arranged at a spacing in the front-to-rear direction. Each of the projections 20, 20 is perpendicular to the connecting wall 10 and also to the direction of flow of oil and is positioned within a vertical plane parallel to the right-to-left direction. The projections 20, 21 are so sized as not to block the space between the adjacent fins 11 and are formed by slitting the connecting wall 10. The space above the wall 10 communicates with the space therebelow through the holes formed by slitting. Between each two adjacent fins 11, the upward projections 20 and the downward projections 21 are arranged alternately in the front-to-rear direction. Oil flows in the direction of arrows 6.

The projection on the connecting wall may be positioned in a vertical plane which is slightly inclined forward or rearward when seen from above, with respect to a vertical plane parallel to the right-to-left direction.

Figure 5:
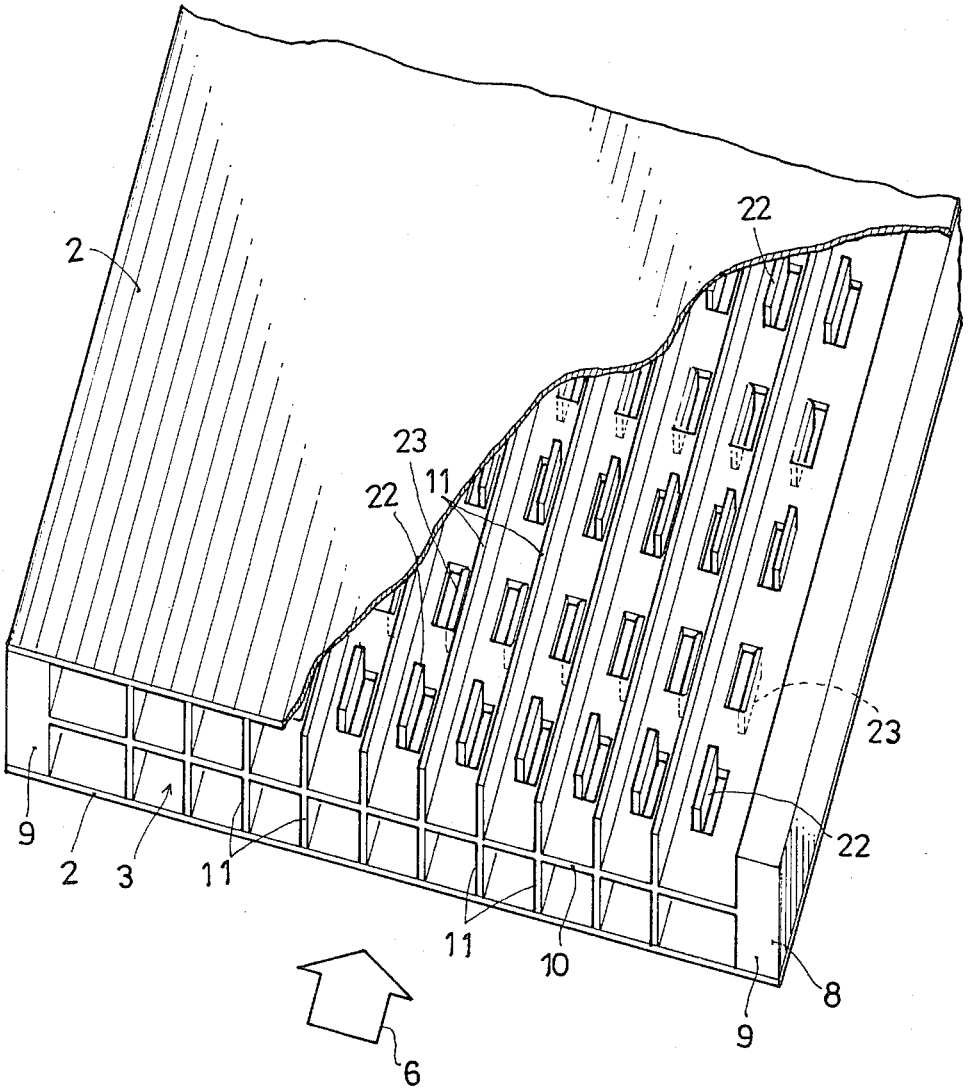
FIG. 5 is a view similar to FIG. 4 and showing a third modification of the same.

With reference to FIG. 5, a connecting wall 10 is provided on its upper and lower surfaces with turbulence producing projections 22 and 23, respectively arranged at a spacing in the front-to-rear direction and perpendicular to the connecting wall 10. Each of the projections 22, 23 are positioned in a vertical plane parallel to the direction of flow of oil. The projections 22 and 23 are formed by slitting the connecting wall 10. The space above the wall 10 communicates with the space therebelow through the holes formed by slitting. The upward projections 22 and the downward projections 23 are arranged alternately in the front-to-rear direction. The upward projections 22 are aligned on a line and the downward projections 23 are aligned on another line, these lines extending in the front-to-rear direction and being spaced apart by a distance in the right-to-left direction. With respect to the right-to-left direction, the projections 22 and 23 are arranged rightward and leftward alternately.

The projection on the connecting wall may be positioned in a vertical plane which is slightly inclined rightward or leftward when seen from above, with respect to a vertical plane parallel to the front-to-rear direction.

With reference to FIGS. 4 and 5, the oil through the first fluid channel 3 flows also upward or downward through the holes formed when the projections 20 to 23 are formed. The oil flow is thus disturbed and also disturbed by the projections 20 to 23, whereby the oil is fully agitated to achieve an improved heat exchange efficiency.

Figure 6:
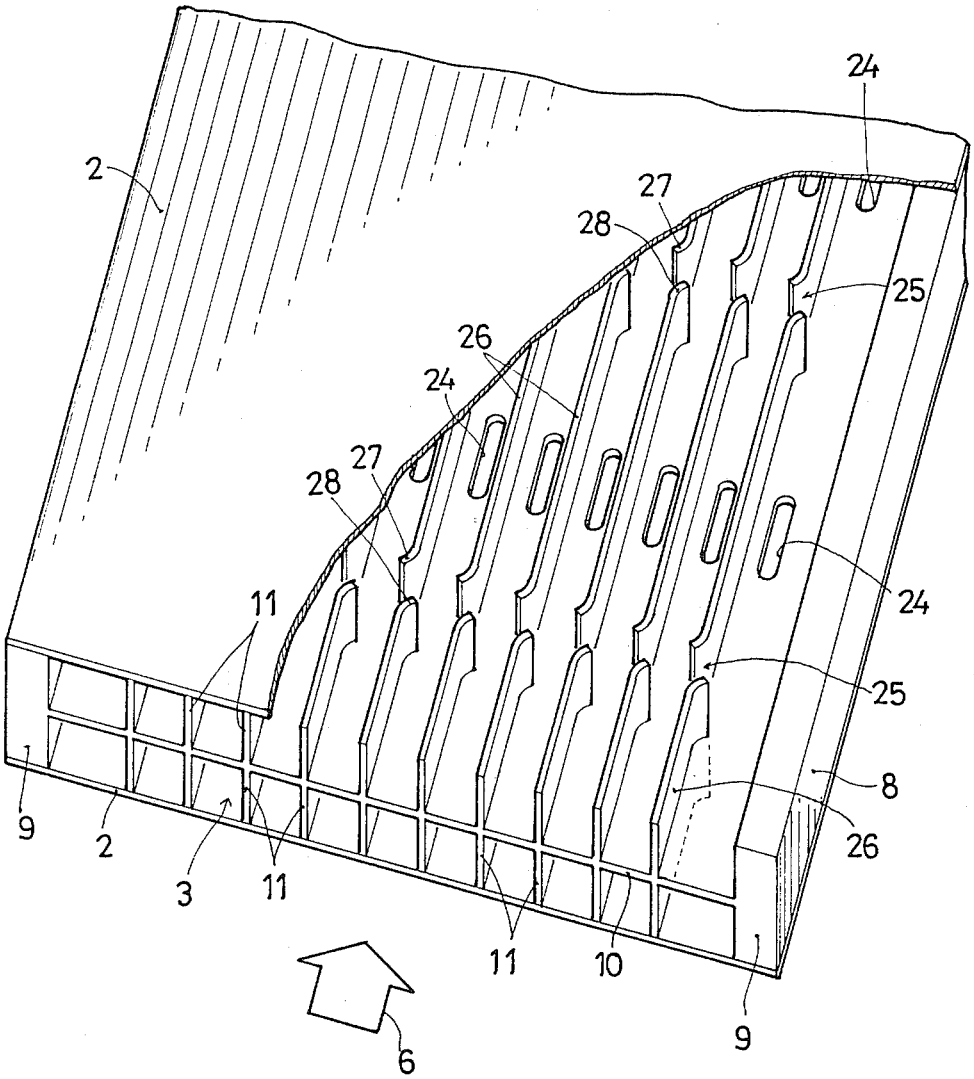
FIG. 6 is a view similar to FIG. 4 and showing a fourth modification of the same.

FIG. 6 shows a connecting wall 10 which is formed with holes 24 elongated in the front-to-rear direction and arranged in this direction at a specified spacing. Each fin 11 is formed with a plurality of cutouts 25 spaced apart by a distance in the above direction and is thereby divided into a plurality of segments 26. The cutout 25 is positioned between two elongated holes 24 which are adjacent to each other in the front-to-rear direction. The rear end of each segment 26 other than the rearmost segment 26 is bent leftward to provide a leftward bent portion 27. The front end of each segment 26 other than the foremost segment 26 is bent rightward to provide a rightward bent portion 28. By virtue of provision of the elongated holes 24, cutouts 25 and bent portions 27, 28, the oil through the first fluid channel 3 flows vertically and also rightward or leftward, whereby the flow of oil is disturbed and fully agitated to achieve an improved heat exchange efficiency. It is desirable that the bent portions 27 and 28 of the fins 11 be so shaped that portions of oil will flow rightward against the flow of air.

Figure 7:
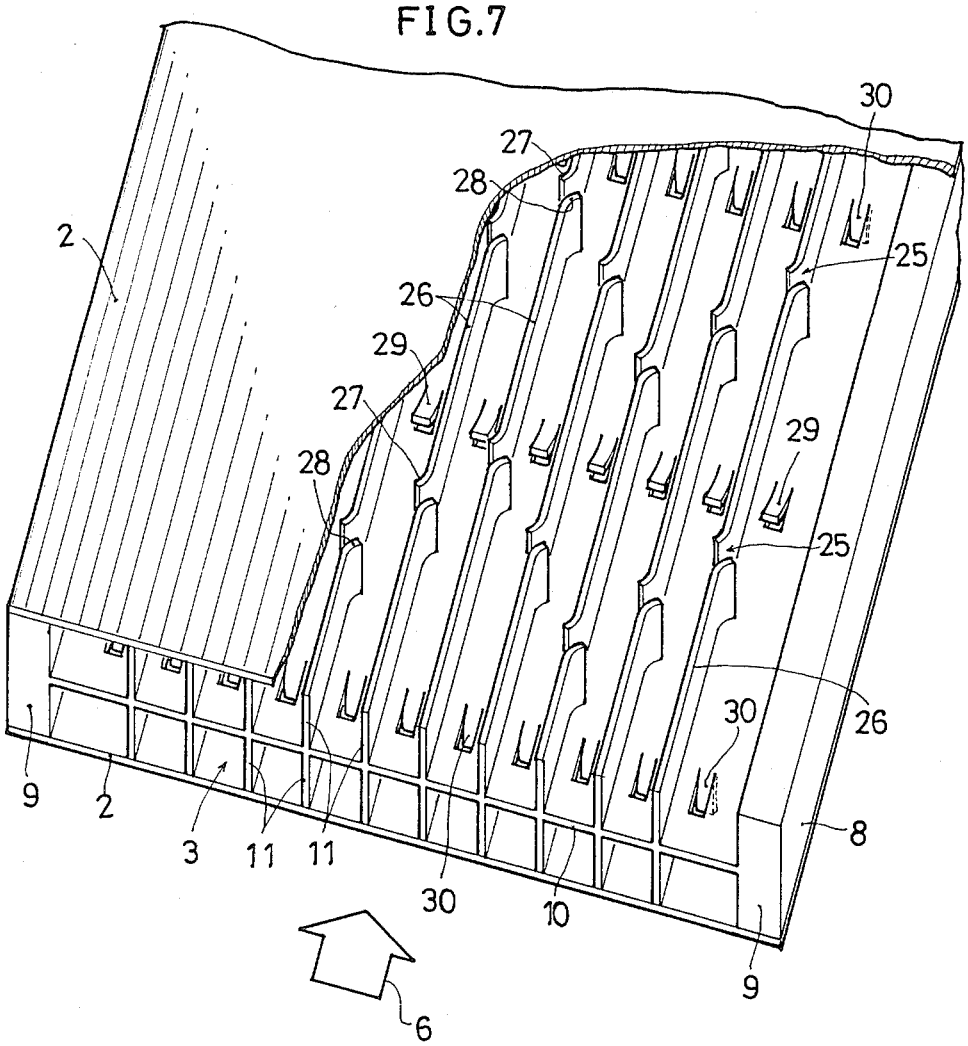
FIG. 7 is a view similar to FIG. 4 and showing a fifth modification of the same.

FIG. 7 shows a connecting wall 10 which is provided on its upper and lower surfaces with a plurality of projections 29 and 30 arranged at a specified spacing in the front-to-rear direction. Each of the projections 29, 30 is formed by forming a generally U-shaped cut in the wall 10 and bending the cut end obliquely upward or downward. The upward projections 29 and the downward projections 30 are arranged alternately in the front-to-rear direction. Each fin 11 is formed with cutouts 25 which are arranged at a spacing in the front-to-rear direction. Each of these cutouts 25, other than those formed in some fins 11 at specified positions, is positioned on a line which is inclined forwardly rightward when seen from above. The oil through the first fluid channel 3 is caused to flow vertically and also from the left rightward by the projections 29, 30, the holes formed in the connecting wall 10 when the projections 29, 30 are formed, the cutouts 25 and bent portions 27, 28, whereby the flow of oil is disturbed and fully agitated to achieve an improved heat exchange efficiency. The above structure is desirable because the oil partly flows rightward against the flow of air.

Figure 8:
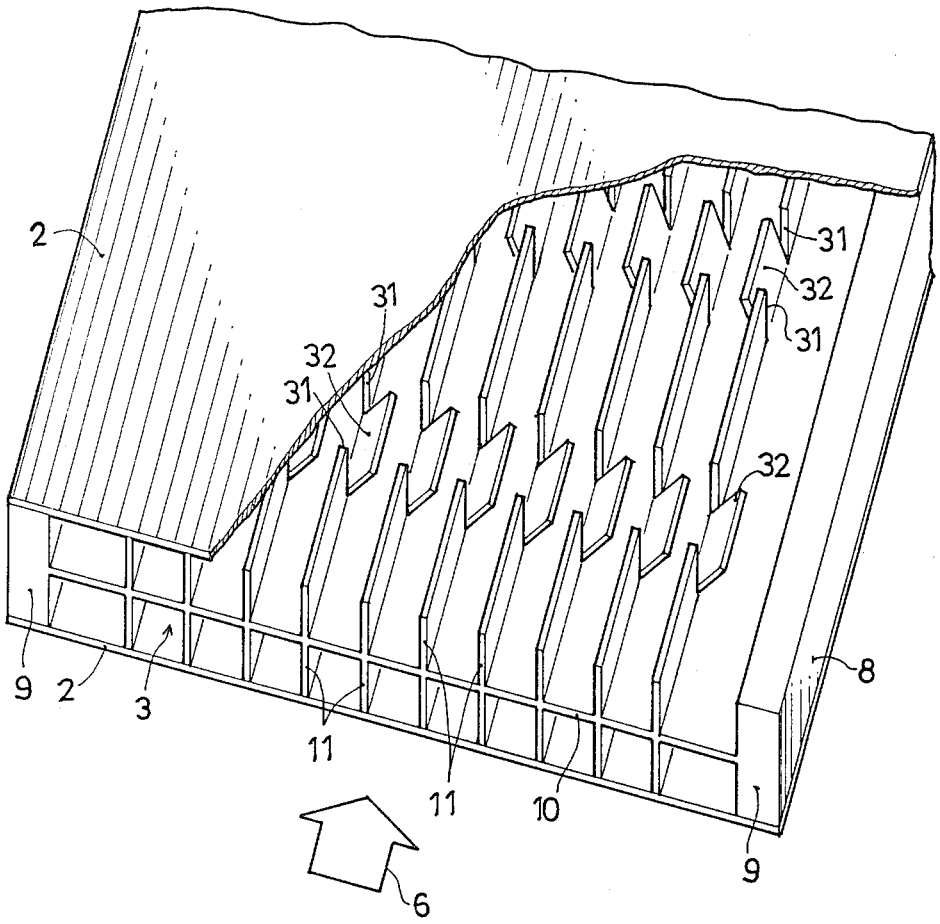
FIG. 8 is a view similar to FIG. 4 and showing a sixth modification of the same.

FIG. 8 shows fins 11 which have pairs of incisions 31 extending downward from the upper edge and spaced apart longitudinally of the fins by a distance, the incisions in each pair being also spaced apart longitudinally of the fin. The fin portions, each defined by the pairing incisions 31, are bent rightward and leftward alternately to provide a plurality of bladelike bent portions 32. The bent portions 32 and the incisions 31 formed in the fins 11 for providing the bent portions 32 disturb the flow of oil to fully agitate the flow to achieve an increased heat exchange efficiency.

Figure 9:
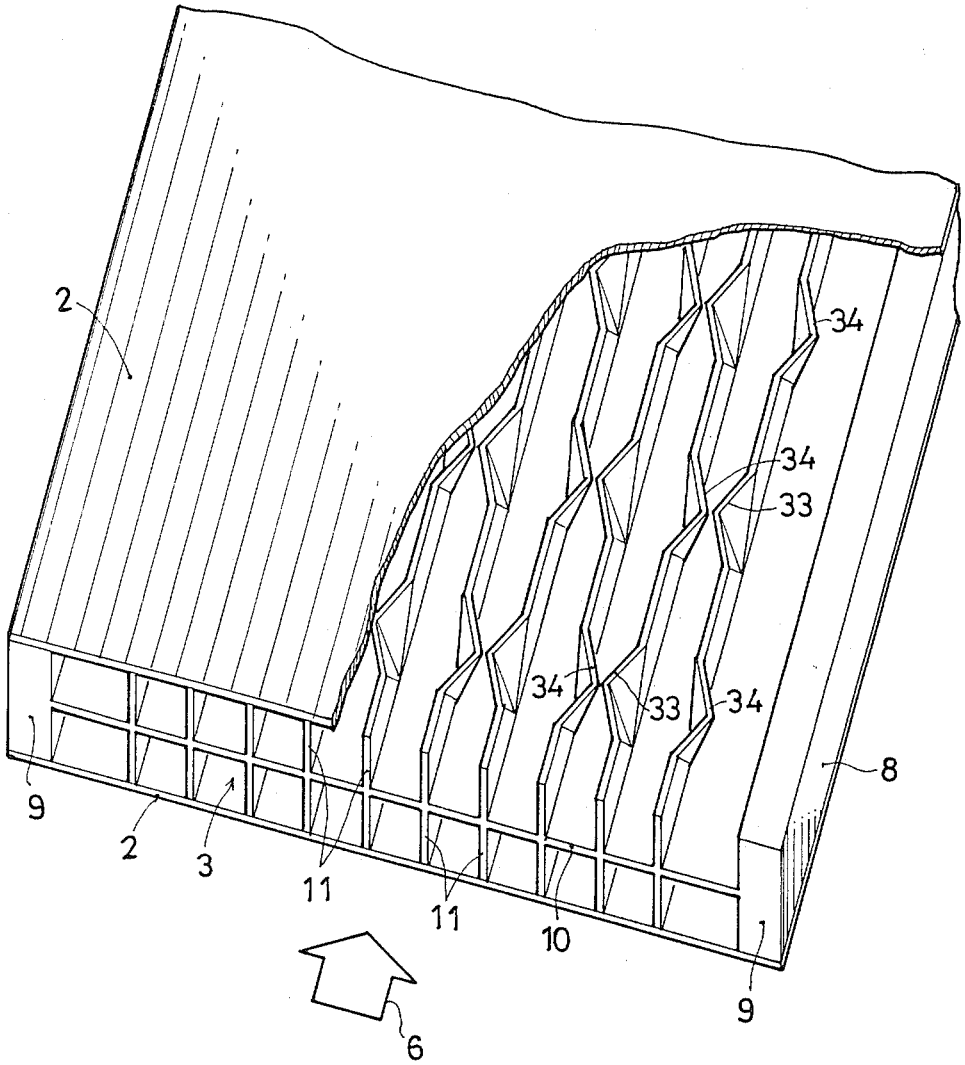
FIG. 9 is a view similar to FIG. 4 and showing a seventh modification of the same.

FIG. 9 shows fins 11 which have generally V-shaped bent leftward projections 33 and generally V-shaped bent rightward projections 34 arranged alternately longitudinally thereof at a specified spacing. The adjacent fins 11 differ in the order of arrangement of the bent projections 33, 34, i.e. in the order of bending directions, so that the ends of projections 33, 34 are positioned close to each other. There is a space between the bent projections 33, 34 and the flat plate 2.

Figure 10:
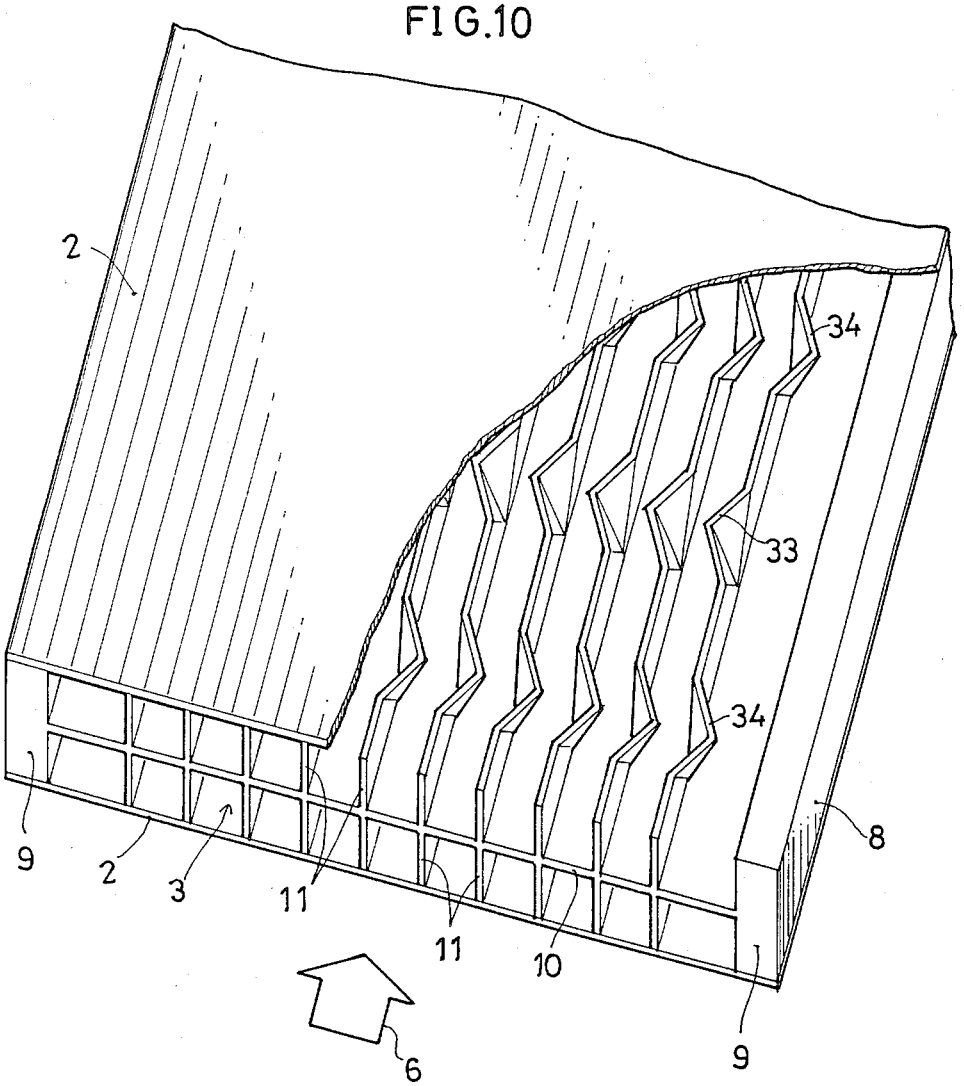
FIG. 10 is a view similar to FIG. 4 and showing an eighth modification of the same.

With reference to FIG. 10, all fins 11 are identical in the positions of bent leftward projections 33 and bent rightward projections 34 with respect to the front-to-rear direction and in shape when seen from above.

Although not shown, the fins 11 may be formed only with projections which are bent in the same direction. In this case, the fins 11 above the connecting wall 10 may be the same as, or opposite to, the fins 11 below the wall 10 in the direction of bending of the projections.

In these cases, the bent projections 33 disturb and fully agitate the flow of oil through the first fluid channel 3 to achieve an improved heat exchange efficiency.

Figure 11:
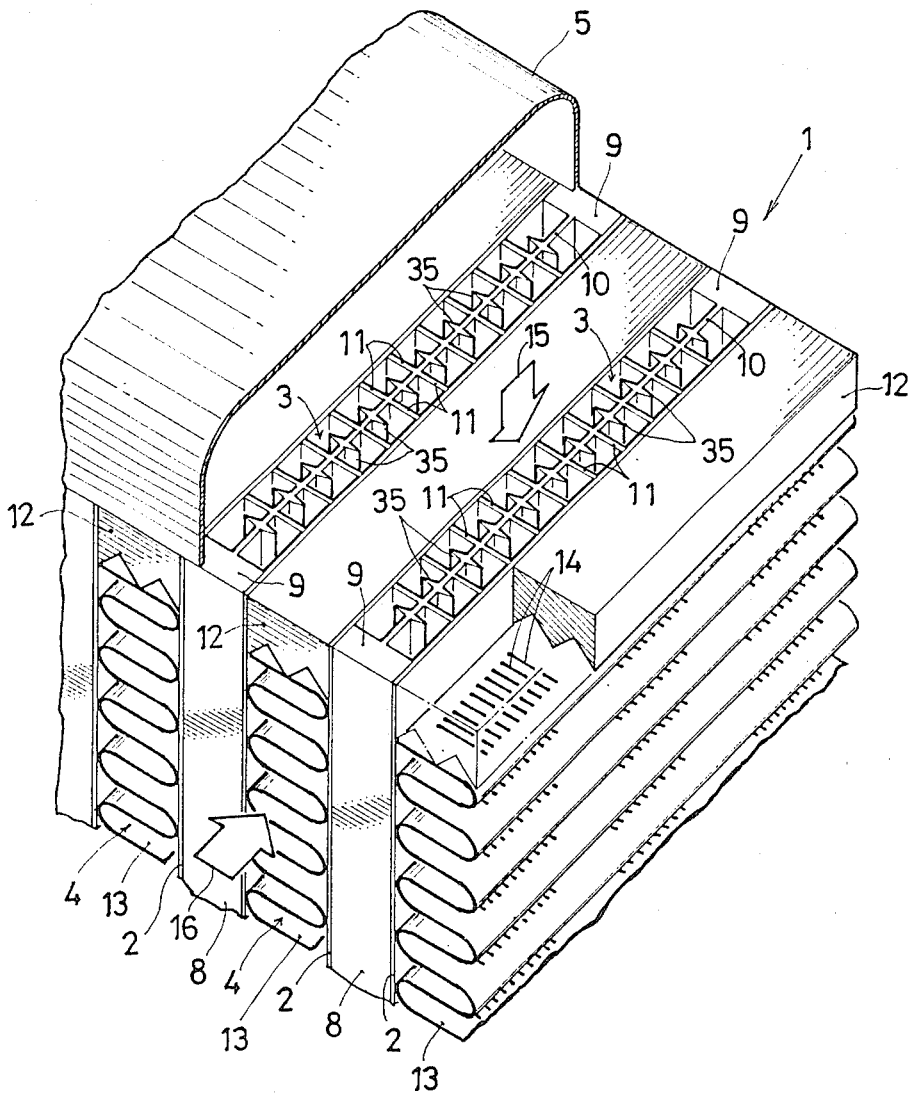
FIG. 11 is a fragmentary perspective view partly broken away and showing an embodiment of plate fin-type heat exchanger of the invention for use as a condenser.

FIG. 11 shows a second embodiment of the invention, i.e. a heat exchanger 1 for use as a condenser. The heat exchanger 1 has vertical flat plates 2 and is adapted to pass a heat transmitting medium through first fluid channels 3 from above downard as indicated by arrows 15 in FIG. 11. Between each two adjacent fins 11, as well as between each side wall 9 and the end fin 11 adjacent thereto, the connecting wall 10 of the spacer 8 is integrally formed on each surface thereof with a ridge 35 extending longitudinally of the fins 11 and having a triangular cross section.

With the heat exchanger 1, a gaseous heat transmitting medium enters the upper ends of the first fluid channels 3 from the header tank 5 and flows downward through the channels 3. On the other hand, air flows through the second fluid channels 4 in the direction of arrows 16 in FIG. 11. The heat of the medium transfers directly and via the spacers 8 to the aluminum flat plates 2, from which the heat transfers to the air flowing through the second fluid channels 4, directly and via the corrugated fins 13. The gaseous medium condenses when thus cooled. The liquid medium flows out from the lower ends of the channels 3.

Figure 12:
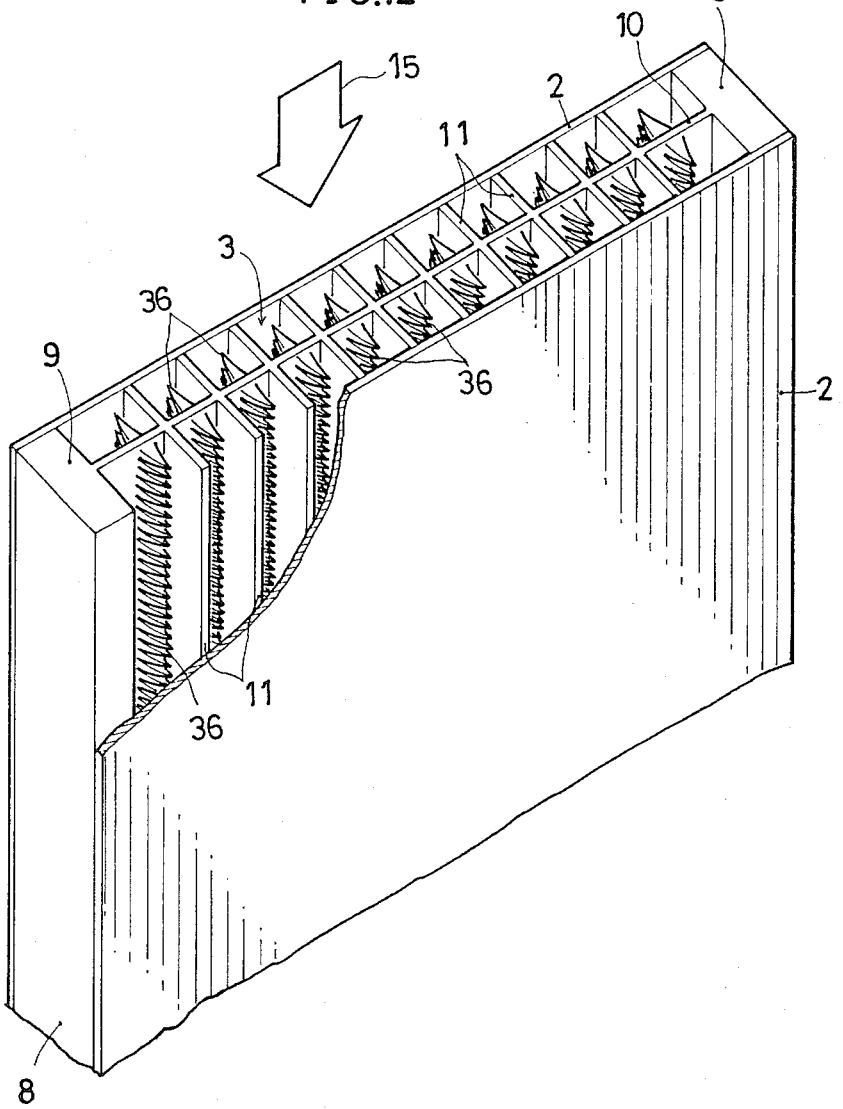
FIG. 12 is an enlarged fragmentary perspective view partly broken away and showing a first modification of the first fluid channel included in the embodiment of FIG. 11.
Figure 13:
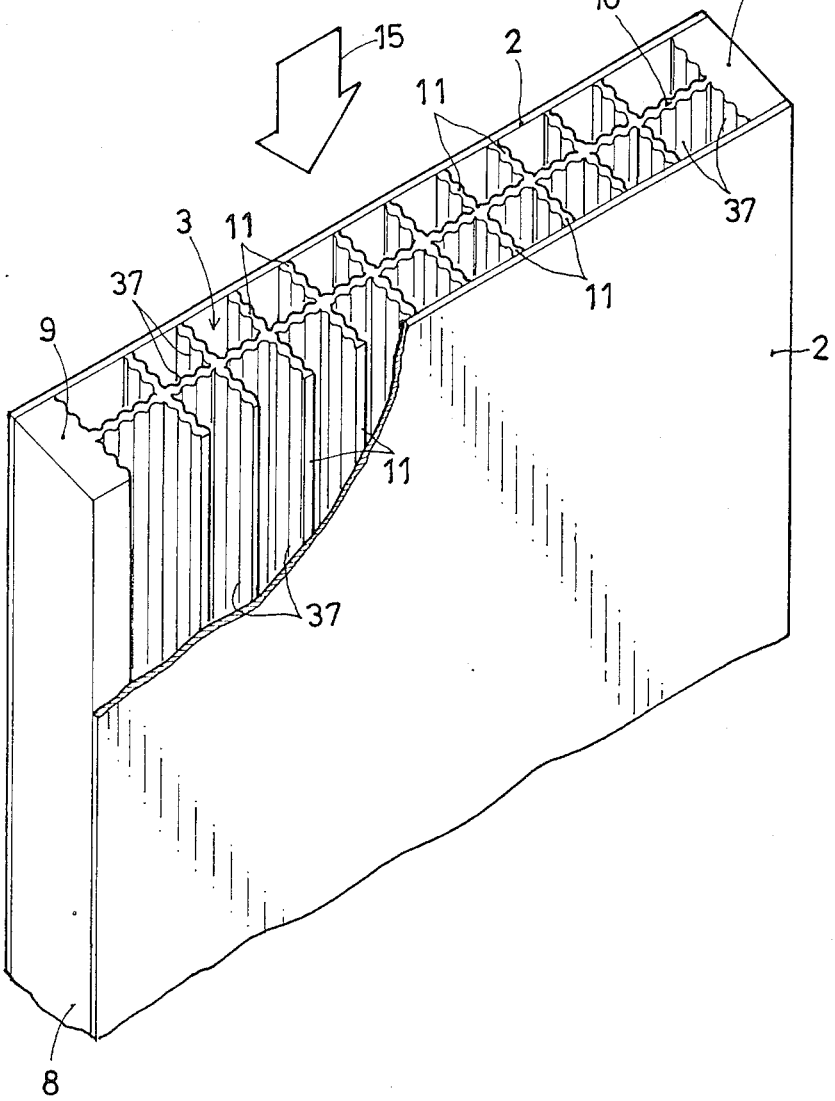
FIG. 13 is a view similar to FIG. 12 and showing a second modification of the same.
Figure 14:
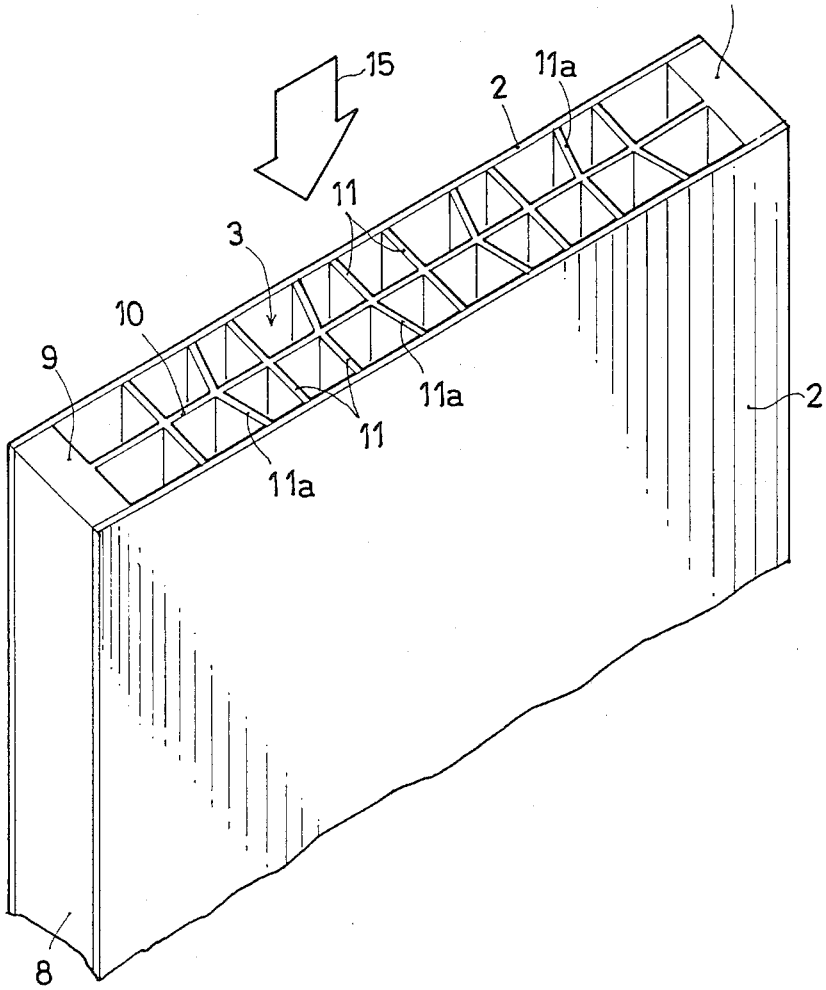
FIG. 14 is a view similar to FIG. 12 and showing a third modification of the same.

FIGS. 12 to 14 show modifications of the first fluid channel 3 for the heat transmitting medium of the heat exchanger for use as a condenser.

Referring to FIG. 12, each surface of a connecting wall 10 is formed with a multiplicity of fins 36 between adjacent fins 11, as well as between each side wall 9 and the end fin 11 adjacent thereto. The fins 36 are arranged longitudinally of the fins 11 at a spacing and formed by skiving the wall 10.

With reference to FIG. 13, a large number of small ridges 37 extending longitudinally of a channel 3 are formed by grooving on side walls 9, connecting wall 10 and fins 11.

With reference to FIGS. 11 to 13, the ridges 35, fins 36 or ridges 37 give the spacer 8 in the first fluid channel 3 an exceedingly larger surface area than when they are absent and further disturb the flow of medium, thus achieving an improved heat exchange efficiency.

FIG. 14 shows fins 11 including some fins 11*a* which are inclined with respect to flat aluminum plates 2. The inclined fins 11*a* give the spacer 8 a larger surface area defining the flow channel 3 than when all the fins 11 are perpendicular to the flat plates 2, further disturbing the flow of medium to achieve an improved heat exchange efficiency.

Figure 15:
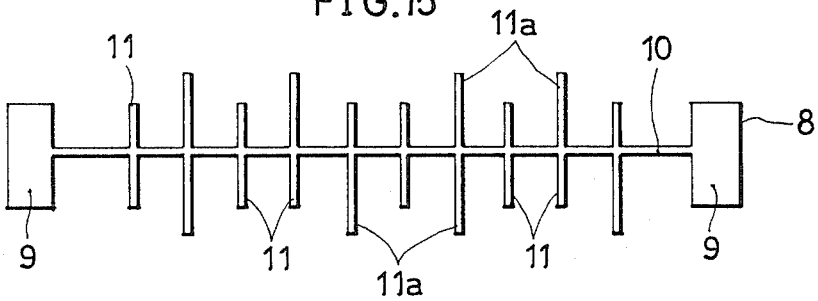
FIG. 15 is a cross sectional view showing the spacer used for the first flow channel of FIG. 14 before the spacer is incorporated into the heat exchanger.

FIG. 15 shows this spacer 8 before it is incorporated into the heat exchanger 1 for the first fluid channel. With the spacer 8, the forward ends of the fins 11*a* are a larger distance away from the connecting wall 10 than the forward ends of the other fins 11 and of the side walls 9. When the spacer 8 as held between the flat plates 2 is clamped by unillustrated jig, the fins 11*a* are bent by compression. In this state, the flat plates 2 are joined to the spacer 8 by brazing, whereby the fins 11*a* are fixed in inclined position to the flat plates 2.

Figure 16:
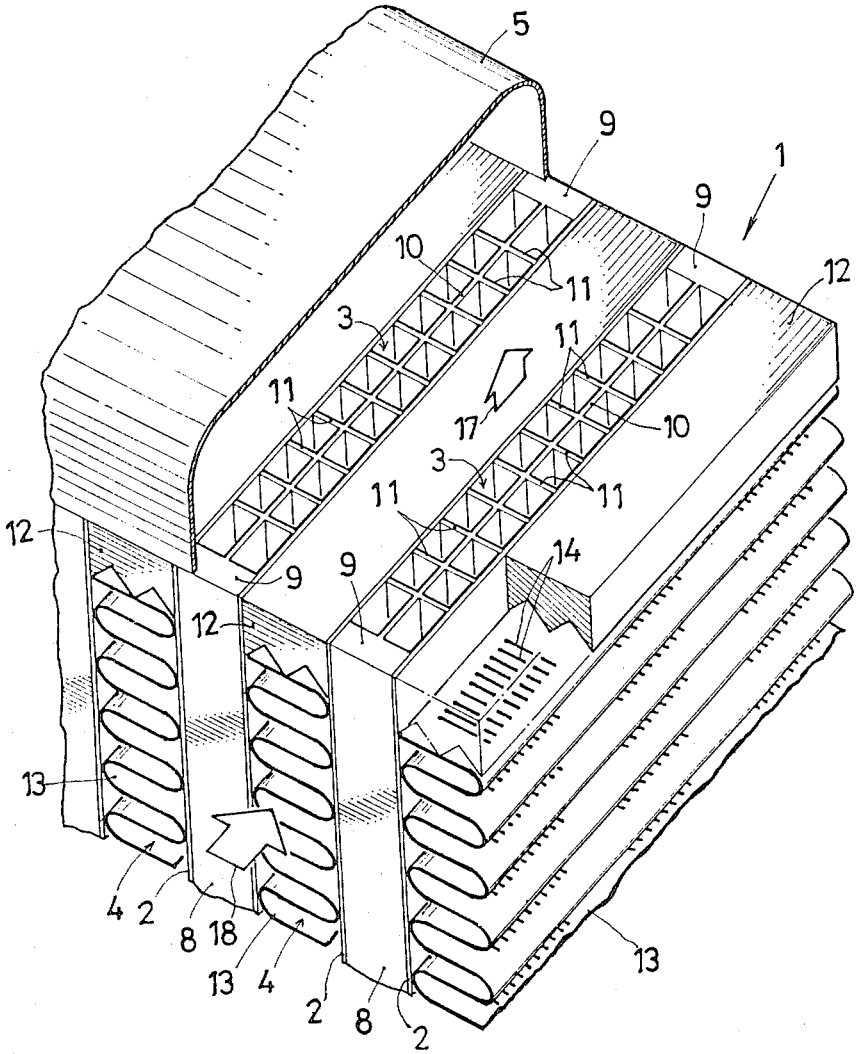
FIG. 16 is a fragmentary perspective view partly broken away and showing an embodiment of plate fin-type heat exchanger of the invention for use as an evaporator.
Figure 17:
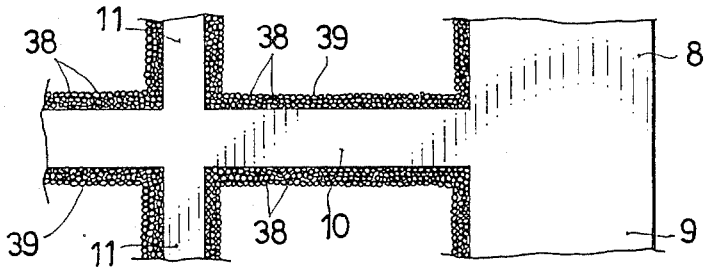
FIG. 17 is an enlarged fragmentary view in cross section showing the spacer incorporated in the first fluid channel portion of the embodiment shown in FIG. 16.

FIGS. 16 and 17 show a third embodiment of the present invention, i.e. a heat exchanger 1 for use as an evaporator. The exchanger 1 is used with flat plates 2 positioned vertically and is adapted to pass a heat transmitting medium through first fluid channels 3 from below upward as indicated by arrows 17 in FIG. 16.

The spacer 8 of the heat exchanger 1 includes side walls 9, a connecting wall 10 and fins 11, and the surfaces of these portions defining the channel 3 are covered with a porous layer 39 which is formed by brazing a multiplicity of aluminum particles 38. The porous layer 39 is formed, for example, by the following method. Finely divided aluminum 38, a powder of brazing material and an organic binder are mixed together and made into a slurry, which is then applied to the spacer 8 before brazing. The finely divided aluminum 38 is preferably 20 to 500 μm in particle size because if it is less than 20 μm or larger than 500 μm, it is impossible to obtain an efficient heat transfer surface for boiling. Further the powder of brazing material is preferably 20 to 200 μm in particles size because it is difficult to industrially produce such a powder with particle sizes of less than 20 μm and further because it is difficult to obtain a uniform particle size distribution when it is larger than 200 μm. The ratio of finely divided aluminum 38 to brazing powder is usually about 8:1 by weight although dependent on the particle size of these materials. The organic binder, which is used for forming the two particulate materials into a uniform coating over the desired surface, decomposes and evaporates during brazing. Thus, when the coating is heated, the organic binder decomposes and evaporates, permitting the finely divided aluminum 38 to adhere to the desired surface of the spacer 8 for brazing and form the porous layer 39. The organic binder evaporates on decomposition during brazing, forming interstices between aluminum particles 38. The particulate aluminum which is present between the forward ends of the fins 11 and the inner surface of the flat aluminum plate 2 is driven out by the bonding force therebetween during brazing, so that these portions can be brazed effectively. The above brazing step is performed when the assembly of flat aluminum plates 2, spacers 8, corrugated fins 13 and spacer bars 12 is brazed. Accordingly, the slurry of finely divided aluminum 38, brazing powder and organic binder needs only to be applied to the spacers 8 before brazing, whereby the porous layer 39 can be formed easily.

With the structure described above, a liquid medium is introduced into the lower ends of the first fluid channels 3 from a header tank 5 and passed upward through the channels 3. On the other hand, air flows through second fluid channels 4 in the direction of arrows 18 in FIG. 16. The heat transferred from the air to the aluminum plates 2 is further transferred to the liquid medium directly or via the spacers 8. The multiplicity of pores or interstices between the aluminum particles 38 in the porous layer 39 then serve as nuclei for forming vapor bubbles of the medium to cause evaporation of medium. In this way, the heat of the air is removed by the medium to cool the air. The resulting gaseous fluid flows out from the upper ends of the channels 3.

With the present heat exchanger 1, the porous layer 39 gives a larger area of heat transfer from the spacer 8 to the medium than when the porous layer is absent to achieve an improved heat exchange efficiency. Moreover, the pores between the aluminum particles 38 in the porous layer 39 serve as nuclei for producing vapor bubbles of the medium to promote the evaporation of the medium. This results in a still higher heat exchange efficiency. Consequently, the heat exchanger can be remarkably improved in heat exchange efficiency and made compact and lightweight.

Although the second fluid channel 4 of the heat exchangers described is formed by the flat plates 2, corrugated fin 13 and spacer bars 12, the channel 4 may alternatively be formed by the flat plates, corrugated fin 13 and spacer 8.

The heat exchangers described above are not limited to the uses mentioned but are usable also for other applications.

With the spacers shown in FIGS. 4 to 14 and 17, the connecting wall interconnects the side walls at their intermediate portions, but the side walls may alternatively be connected together each at is one end as seen in FIG. 3. In this case, turbulence producing projections, ridges, skived fins, porous layer, etc. are formed on one surface of the connecting wall.

The present invention may be embodied differently without departing from the spirit and basic features of the invention. Accordingly the embodiments herein disclosed are given for illustrative purposes only and are in no way limitative. It is to be understood that the scope of the invention is defined by the appended claims and that all alterations and modifications within the definition and scope of the claims are included in the claims.

What is claimed is:

1. A heat exchanger of the plate fin type having first fluid channels and second fluid channels arranged alternately and each separated from the adjacent channel by a flat metal plate, at least one of the first fluid channel and the second channel being formed by a pair of adjacent flat metal plates and a spacer interposed between the flat plates, the spacer comprising a pair of side walls each joined to an interconnecting a pair of opposed edges of the two flat plates at each side thereof, a connecting wall interconnecting the two side walls and spaced apart from the opposite flat plates in parallel therewith, and fins provided on the opposite surfaces of the connecting wall at a right angle therewith and joined at their forward ends to the flat plate, the fins extending in parallel with the direction of flow of fluid through the fluid channel, wherein each fin is further provided with a plurality of bent portions projecting to at least either of the right and the left at a specified spacing in the direction of flow of fluid, each bent portion having a 'V'-shape oriented transversely of the direction of fluid flow and opened toward the side at which the bent portion does not project, when cut along a plane parallel with the connecting wall, said 'V'-shape being the largest at the side of the flat plate and gradually getting smaller as it comes close to the connecting wall portion, and in a next row of passages being the largest at the side of said connecting wall and gradually getting smaller as it comes close to said flat plate, and a flat portion of said fin provided between the bent portions adjacent to each other in the direction of flow of fluid.

2. A heat exchanger as defined in claim 1 in which each of the side walls has a larger thickness than each fin.

* * * * *